US006316868B1

(12) United States Patent
Ishino et al.

(10) Patent No.: US 6,316,868 B1
(45) Date of Patent: Nov. 13, 2001

(54) SPARK PLUG FOR INTERNAL COMBUSTION ENGINE HAVING BETTER SELF-CLEANING FUNCTION

(75) Inventors: Yasutake Ishino, Kariya; Hironori Osamura, Chiryu; Makoto Yatou, Toyota, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/453,030

(22) Filed: Dec. 2, 1999

(30) Foreign Application Priority Data

Dec. 4, 1998 (JP) ..... 10-345991
Sep. 22, 1999 (JP) ..... 11-268963

(51) Int. Cl.[7] ..... H01T 13/46
(52) U.S. Cl. ..... 313/141; 313/123
(58) Field of Search ..... 313/141, 142, 313/145, 123; 123/169 EL

(56) References Cited

U.S. PATENT DOCUMENTS 4,845,400 * 7/1989 Takamura et al. ..... 313/141 X
5,239,225 * 8/1993 Moriya et al. ..... 313/141
5,877,584 * 3/1999 Kato et al. ..... 313/141 X
5,952,770 * 9/1999 Mueller et al. ..... 313/141

FOREIGN PATENT DOCUMENTS 677 818 A 8/1966 (BE) .
0 774 813 A1 5/1997 (EP) .
964490 12/1999 (EP) .
49-120932 2/1948 (JP) .
47-19236 9/1972 (JP) .
53-41629 10/1978 (JP) .
60-81784 5/1985 (JP) .
3-50396 8/1991 (JP) .

* cited by examiner

*Primary Examiner*—Ashok Patel
(74) *Attorney, Agent, or Firm*—Pillsbury Winthrop LLP

(57) ABSTRACT

In a spark plug having a center electrode, first and second ground electrodes, an insulator and a metal housing, a first discharge gap is constituted between a front end of the center electrode and a front side of the first ground electrode and a second discharge gap is constituted between a front end of the second electrode and a front side of the center electrode. Respective dimensional relationships of A, B, C, H, F and L1 are defined where A is a distance of the first discharge gap, Bis a shortest distance between the front end of the second ground electrode and the insulator, C is an axial length from a leading end of the metal housing and a front end of the insulator, H is an axial length from the front end of the insulator and the front end of the center electrode, F is an axial length from the front end of the insulator to the front end edge of the second electrode and L1 is a shortest axial length from the leading end of the metal housing to the front end of the second ground electrode.

7 Claims, 5 Drawing Sheets

SPARK PLUG FOR INTERNAL COMBUSTION ENGINE HAVING BETTER SELF-CLEANING FUNCTION

BACKGROUND OF THE INVENTION

1. Field of the Invention

The present invention relates to a spark plug for internal combustion engine having a better self-cleaning function in use of surface creeping spark discharges.

2. Description of Related Art

Recently, as the environmental preservation has been watched with more keen interest, stratified charge internal combustion engines with lower fuel consumption have been widely noticed as environment-friendly engines.

However, when stratified fuel mixtures are burned in a combustion chamber, rich fuel mixtures are concentrated near a spark slug so that the spark plug may tend to be smoldered or fouled by carbon. The carbon-fouling makes an insulation property of an insulator surrounding a center electrode worse so that a spark discharge may not occur across a regular discharge gap provided between center and ground electrodes but occur between the insulator, on a surface of which carbon is deposited, and an inside of a metal housing for mounting at a portion deep into the metal housing from a front end surface of the insulator.

To cope with this problem, there are known self-cleaning spark plugs as disclosed in JP-Y2-53-41629 or JP-A-4719236.

According to JP-Y2-53-41629, the spark plug has a plurality of electrodes constituting first and second ground electrodes. A first discharge gap is formed between the first ground electrode and the center electrode and a second discharge gap is formed between the second ground electrode and the center electrode. A regular spark discharge occurs through the first discharge gap and, when the insulator is fouled by carbon deposit, a spark discharge occurs through the second discharge gap, not through the portion deep into the metal housing, so that carbon may be burned without decreasing ignitability of the spark plug.

Further, according to JP-A-47-19236, there are provided with the regular first discharge gap and the second discharge gap through which sparks are discharged when the insulator is fouled. It is characterized, in this case, that a front end of the center electrode is nearly equal in height to a front end of the insulator.

Therefore, as the spark discharge at the first discharge gap occurs at a position nearly same in height as the second discharge gap, it is contemplated, therefore, that the respective ignitability characteristics at both first and second discharge gaps do not have much difference.

However, the spark plug according to JP-Y2-4719236 has a drawback that there exists a big difference of ignitability between the respective spark discharges at the first and second discharge gaps, since the second discharge gap formed at a leading end of the metal housing is arranged at a position far away from the first discharge gap, so that drivability is adversely affected, in particular, in the stratified fuel combustion.

Further, as the spark discharge at the second discharge gap occurs at a place deep from the leading end of the insulator into an insulator base, channeling is likely to occur. on the other hand, according to the spark plug disclosed in JP-A-4719236, there is also a problem that ignitability is not good, as the front end of the first electrode is obliged to be almost same in height as the front end of the insulator so that the front end of the insulator may operate to cool flame cores generated by spark discharge at the first discharge gap.

SUMMARY OF THE INVENTION

The present invention has been made in view of the above mentioned problem, and an object of the present invention is to provide a spark plug for internal combustion engines in which a remarkably Longer life time of fouling resistance is secured in such a manner that an air-gap spark discharge with a good ignitabilty usually occurs at a first discharge gap and, when the insulator is fouled, a surface creeping spark discharge occurs at a second discharge gap to burn carbon deposited on the surface of the insulator.

To achieve the above object, the spark plug has a center electrode, first and second ground electrodes, an insulator and a metal housing. The first discharge gap is constituted between a front end of the center electrode and a front side of the first ground electrode and the second discharge gap is constituted between a front end of the second electrode and a front side of the center electrode. In this case, dimensional relationships of the center electrode, the first and second ground electrodes, the insulator and the metal housing are respectively in ranges of, $0.7\ \text{mm} \leqq A \leqq 1.3\ \text{mm}$, $0.3\ \text{mm} \leqq B \leqq A-0.1\ \text{mm}$ $1.0\ \text{mm} \leqq C \leqq 4.0\ \text{mm}$, $0.5\ \text{mm} \leqq H \leqq 3.0\ \text{mm}$, $1.0\ \text{mm} \leqq F \leqq +0.5\ \text{mm}$, and $1.0\ \text{mm} \leqq L1 \leqq C+0.5\ \text{mm}$, where A is a distance of the first discharge gap, B is a shortest distance between the front end of the second ground electrode and the insulator, C is an axial length from a leading end of the metal housing and a front end of the insulator, H is an axial length from the front end of the insulator and the front end of the center electrode, F is an axial length from the front end of the insulator to the front end edge of the second electrode, and L1 is a shortest axial length from the leading end of the metal housing to the front end of the second ground electrode.

Further it is preferable that the center electrode is shaped as a column having a base electrode portion and a diametrically reduced electrode portion whose diameter is smaller than a diameter of the base electrode portion. A base point where the diametrically reduced electrode portion starts is located inside by 0.1 to 0.8 mm from the, front end of the insulator. The spark discharge starting from the base point at the second discharge gap hits at first inner periphery surfaces of the insulator, then, proceeds so as to surround and creep along surfaces of the leading end of the insulator and, finally, reaches the second ground electrode. In this case, the spark discharge runs into carbon deposited on the leading end of the insulator so that the carbon may be burned or scattered by spark energy, thus cleaning the carbon fouling on the insulator. It is preferable to have a small gap between the base point of the center electrode and the inner surface of the insulator in order to cause the spark discharge through the small gap.

Furthermore, when a formula, $B+D \geqq A$, is satisfied, where D is a radial thickness of the front end of the insulator, the spark discharge position may be effectively changed between the usual spark discharge at the first discharge gap and the carbon-fouling spark discharge at the second discharge gap.

Further, the insulator is, preferably, provided at a vicinity of the front end thereof with a diametrically reduced insulator portion whose diameter is nearly uniform in an axial direction and is smaller than a diameter of the base insulator portion. A shortest axial length E from the front end of the second ground electrode to a point where the diametrically reduced insulator portion starts should be in a range of E ≧B+0.1 mm for preventing the spark discharge from occurring deep into the metal housing.

To realize a spark plug having a longer consumption life time, it is preferable that at least one of the front side of the first ground electrode and the front end of the center electrode is provided with a noble metal chip preferably made of any one material of pure Pt, pure Ir, Pt alloy and Ir alloy.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
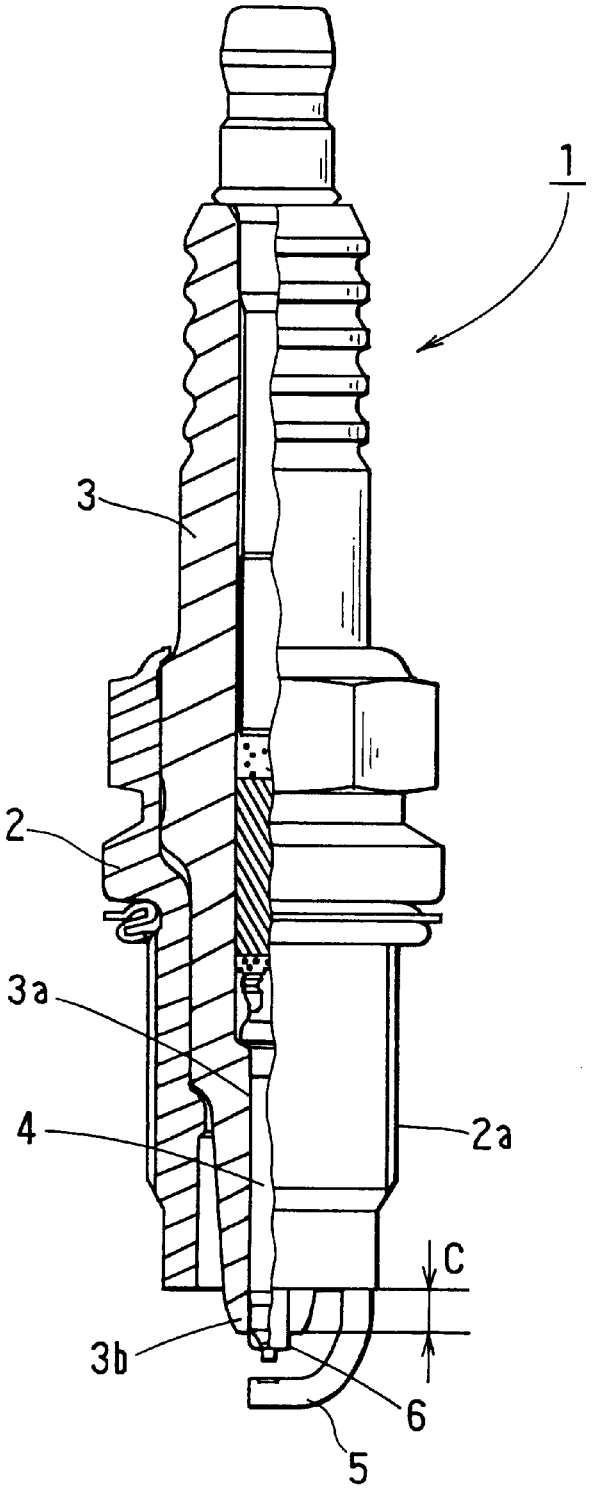
FIG. 1 is a semi cross sectional elevation view of a spark plug according to a first embodiment of the present invention.
Figure 2:
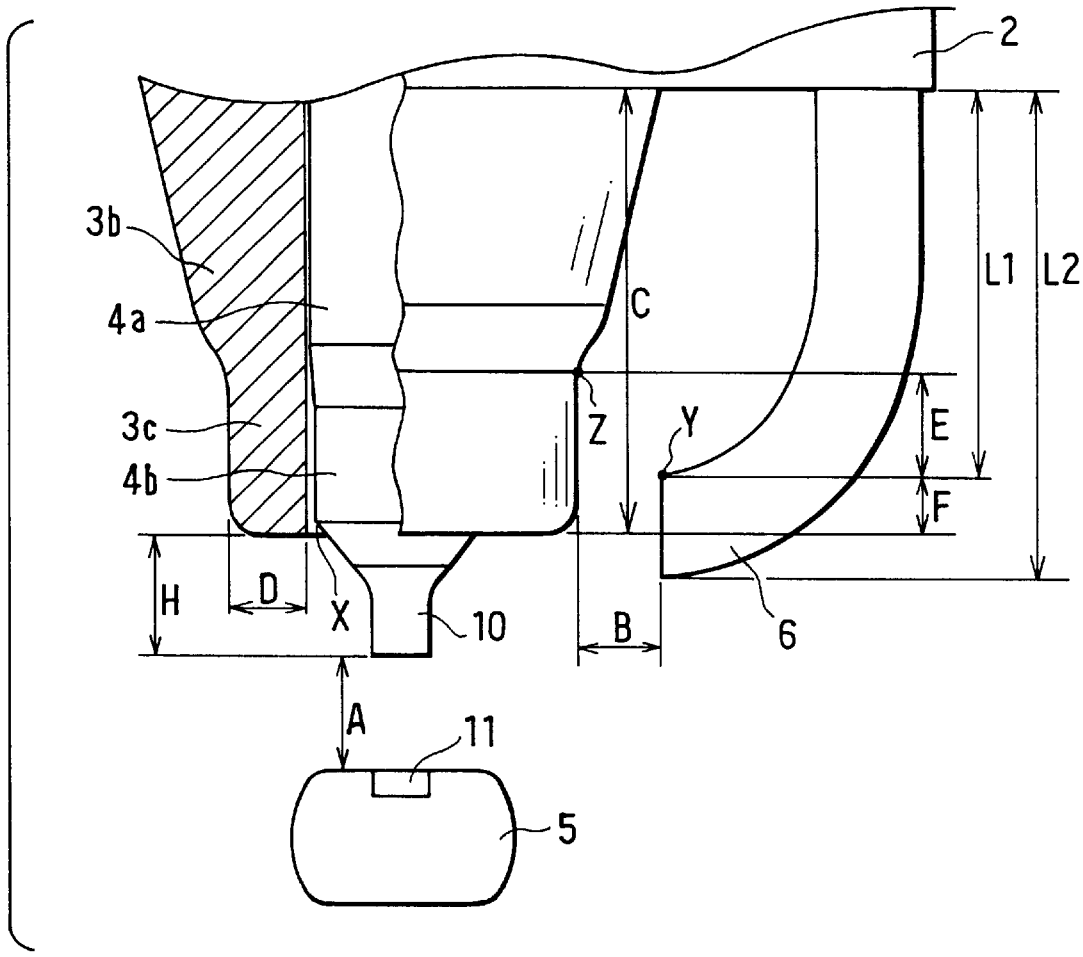
FIG. 2 is a partly enlarged elevation view of the spark plug of FIG. 1.
Figure 3:
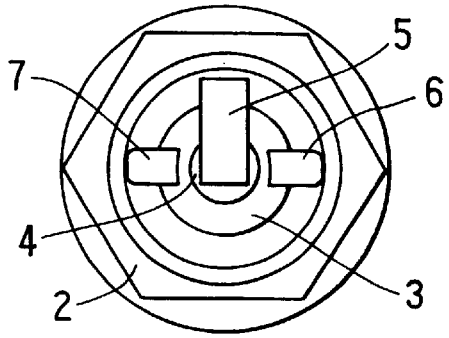
FIG. 3 is a front view of the spark of FIG. 1.

FIGS. 1 to 3 show a spark plug for internal combustion engines according to a first embodiment of the present invention. The spark plug 1 has a tubular metal housing 2 having a thread 2*a* for mounting to an engine cylinder block (not shown). An insulator 3 made of alumina ceramics ($Al_2O_3$) is fitted into the housing 2 and a leading end portion 3*b* of the insulator 3 is exposed out of the front end of the housing 2. A center electrode 4 is inserted and fixed at a through hole 3*a* of the insulator 3 so as to be held by and insulated with the housing 2 through the insulator 3. A leading end portion of the center electrode 4 is exposed out of the leading end portion 3*b* of the insulator 3.

The leading end portion 3*b* of the insulator 3 is provided with a diametrically reduced insulator portion 3*c* whose diameter is nearly uniform in an axial direction and is smaller than a diameter of a base insulator portion of the leading end portion 3*b*, as shown in FIG. 2.

The center electrode 4 is a column whose inner member is composed of metal material having good thermal conductivity such as copper and whose outer member is composed of metal material having good heat resistance and corrosion endurance such as Ni base alloy. As shown in FIG. 2, the front end of the center electrode 4 is exposed out of the diametrically reduced insulator portion 3*c*. An end of a base electrode portion 4*a* is integrally connected to a first diametrically reduced electrode portion 4*b* whose diameter is smaller than that of the base electrode portion 4*a*. Further, a noble metal chip 10 constituting a second diametrically reduced electrode portion is arranged at a leading end of the first diametrically reduced electrode portion 4*b*. A base point X showing a boundary of the first diametrically reduced electrode portion 4*b* and the noble metal chip 10 (the most nearest point from the front end of the insulator 3 where the diameter of the center electrode 4 is reduced to constitute an edge) is located inside by 0.2 mm from the front end of the diametrically reduced insulator portion 3*c*.

As shown in FIGS . 2 and 3, a first ground electrode 5 and second ground electrodes 6 and 7 are fixed respectively by welding to the leading end of the housing 2. Each end of the second ground electrodes 6 and 7 is arranged on a circle whose diameter is larger by a distance B than an outside diameter of the diametrically reduced insulator portion 3*c*. The first and second ground electrode 5, 6 and 7 are composed of Ni base alloy.

The first ground electrode 5 faces the noble metal chip 10 to constitute a first discharge gap between a front end surface or edge of the noble metal chip 10 and a leading end side surface or edge of the first ground electrode 5. Each of the second ground electrodes 6 and 7 also faces the noble metal chip 10 and the insulator 3 to constitute a second discharge gap between a side surface or edge of the noble metal chip 10 including the base point X and a front end surface or edge of the second electrode 6, 7 through the inside and outside surf aces of the insulator 3 (the diametrically reduced insulator portion 3*c*).

The noble metal chip 10 formed at the leading end portion of the center electrode 4 is made of Ir alloy (90 Wt % Ir-10 Wt % Rh in this embodiment). On the other hand, a chip 11 made of Pt alloy (90 Wt % Pt-10 Wt % Ni in this embodiment) is bonded by resistance welding to the surface of the ground electrode 5 at the first discharge gap.

Preferable dimensional relationships among component parts of the spark plug 1 according to the first embodiment are described below with reference to FIG. 2. A distance A of the first discharge gap is 1.1 mm, a shortest distance B between a side surface of the insulator 3 (the diametrically reduced insulator portion 3*c*) and the front end of the second electrode 6, 7 is 0.8 mm, an axial distance C between the leading end of the housing 2 and the front end of the insulator 3 (the diametrically reduced insulator portion 3*c*) is 2.5 mm, a radial thickness D of the front end of the insulator 3 (diametrically reduced insulator portion 3*c*) is 1.0 mm, a shortest axial length E from a starting point Z of the diametrically reduced insulator portion 3*c* to the front end of the second electrode 6 or 7 is 1.0 mm, an axial length H from the front end of the insulator 3 (the diametrically reduced insulator portion 3*c*) to the front end of the noble metal chip 10 is 1.5 mm, a shortest axial length L1 from the leading end of the housing 2 to the front end of the second electrode 6, 7 is 2.0 mm, a longest axial length L2 from the leading end of the housing 2 to the front end of the second electrode 6, 7 is 3.5 mm and an axial length F from the front end of the insulator 3 (the diametrically reduced insulator portion 3*c*) to a front end edge Y of the second electrode 6, 7 on a side of the housing 2 is −0.5 mm (shown as—mark when the front end edge Y does not extrude out of the front end of the insulator 3).

As a test result of the spark plug according to the first embodiment, ignitability and self-cleaning function were satisfactory.

Figure 4:
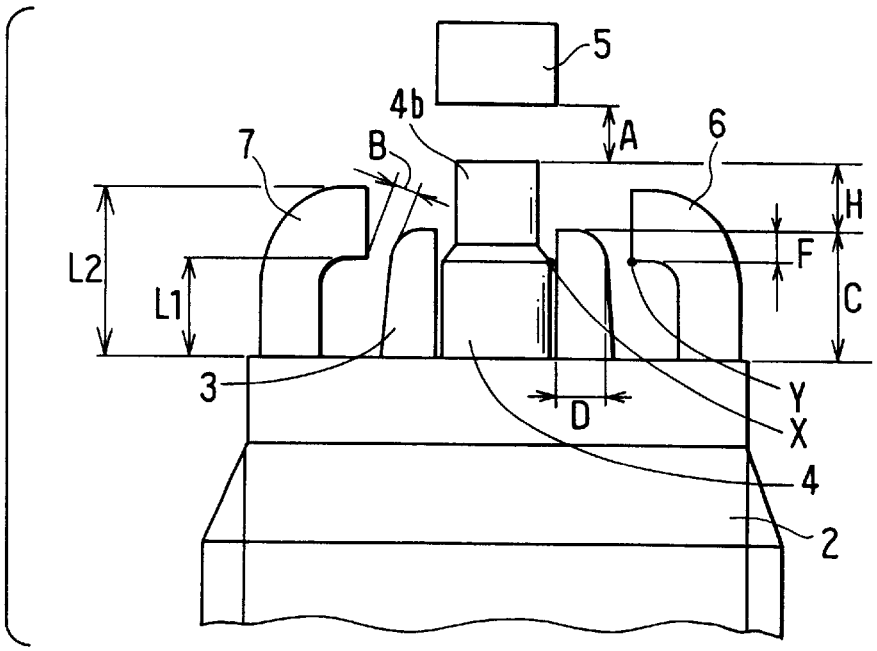
FIG. 4 is a partly enlarged elevation view of a spark plug according to a second embodiment of the present invention.

FIG. 4 shows a spark plug according to a second embodiment of the present invention which is a modification of the first embodiment. According to the second embodiment, the first diametrically reduced electrode portion 4*b* without the noble metal chip 10 is exposed out of the front end of the insulator 3. Therefore, to define the axial length H of the spark plug according to the second embodiment, the front end of the first diametrically reduced electrode portion 4*b* may be used in place of the front end of the noble metal chip 10 as illustrated in the first embodiment. Further, though the base point X of the first embodiment is a boundary of the first diametrically reduced electrode portion 4*b* and the noble metal chip 10, the base point X according to the second embodiment is a boundary of the base electrode portion 4*a* and the first diametrically reduced electrode portion 4*b*. Further, instead of the diametrically reduced insulator portion 3*c* in the first embodiment, the insulator 3 according to the second embodiment has a tapered outside surface portion. Therefore, according to the second embodiment, the shortest axial length E does not exist and the shortest distance B is not a distance perpendicular to the front end surface of the second electrode 6, 7 but a distance perpendicular to the tapered surface of the insulator 3.

Figure 5:
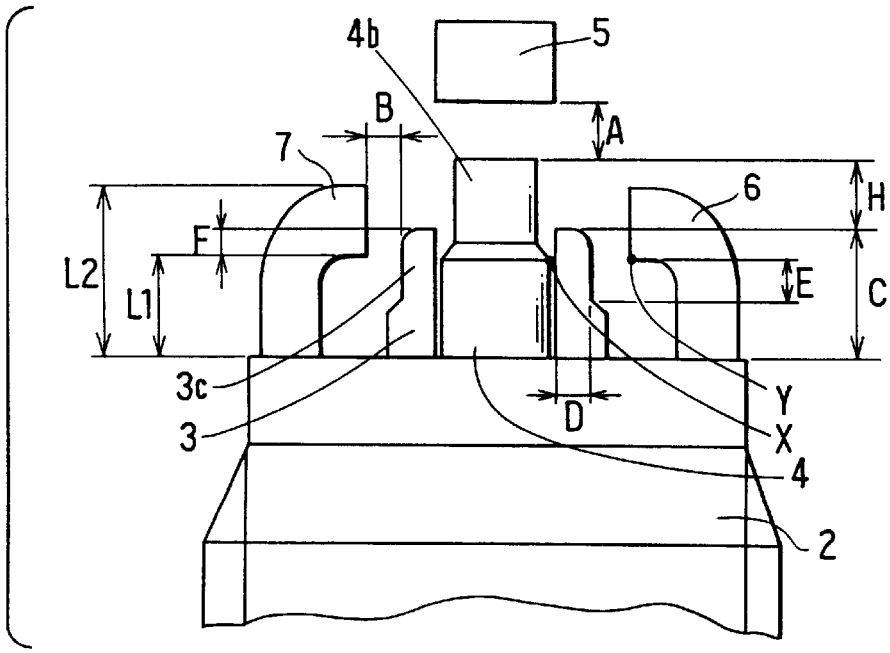
FIG. 5 is a partly enlarged elevation view of a spark plug according to a third embodiment of the present invention.

FIG. 5 shows a spark plug according to a third embodiment of the present invention which is a modification of the first embodiment. According to the third embodiment, the first diametrically reduced electrode portion 4*b* without the noble metal chip 10 is exposed out of the front end of the insulator 3 as shown in the second embodiment.

Figure 6:
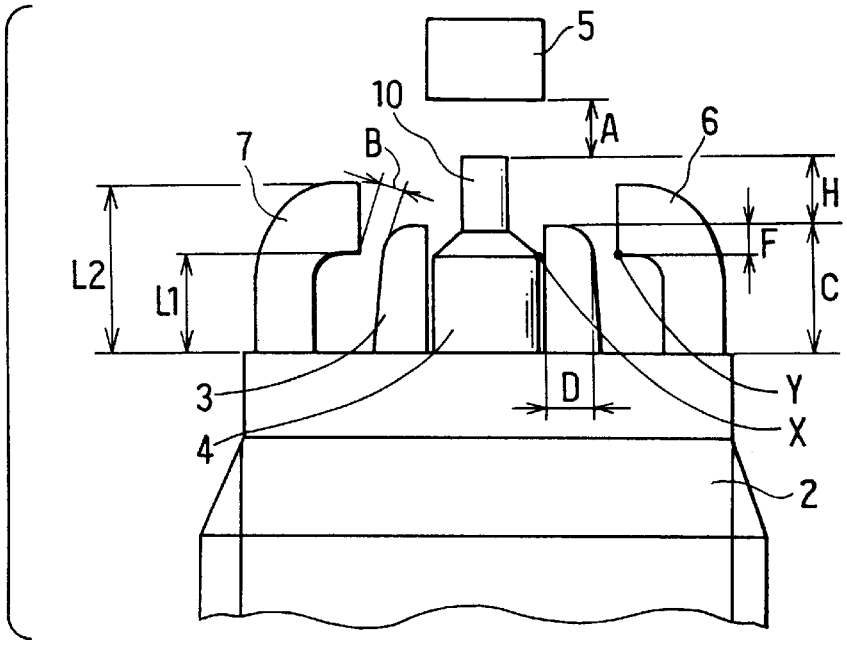
FIG. 6 is a partly enlarged elevation view of a spark plug according to a fourth embodiment of the present invention.

FIG. 6 shows a spark plug according to a fourth embodiment of the present invention which is a modification of the first embodiment. Instead of the diametrically reduced insulator portion 3*c* in the first embodiment, the insulator 3 according to the second embodiment has a tapered outside surface portion as shown in the second embodiment.

The spark plug according to the second, third or fourth embodiment has dimensional relationships among component parts thereof as disclosed in the first embodiment and it has been proved by an experimental test to have same function and effect as the first embodiment with respect to ignitability and self-cleaning function. Though Ir alloy including 10 weight percent Rh is employed as the noble metal chip 10, other noble metal material such as pure Ir or Pt or Pt alloy may be employed to achieve the same function and effect as disclosed in the above embodiments.

Next, to explain more in detail the present invention, the preferable range of each of the dimensions mentioned above is described hereinafter based on the experimental test results and studies thereof.

To define the preferable shortest distance B between the side surface of the insulator 3 and the front end of the second electrode 6, 7, experimental tests were conducted on spark plugs for internal combustion engines in the type as disclosed in FIGS. 1 to 3. After running engines installing test samples of the spark plugs for 30 minutes on idling conditions in order to produce intentionally carbon fouling, an ignitability detection test was conducted. The test samples were prepared by sequentially changing the distance A of the first discharge gap and the shortest distance B. respectively. In these test samples, the axial distance C between the leading end of the housing 2 and the front end of the insulator 3 is 2.5 mm, the radial thickness D of the front end of the insulator 3 is 1.0 mm, the axial length H from the front end of the insulator 3 to the front end of the noble metal chip is 1.5 mm, the shortest axial distance L1 from the leading end of the housing 2 to the front end of the second electrode 6, 7 is 1.5 mm, and the longest axial distance L2 from the leading end of the housing 2 to the front end of the second electrode 6, 7 is 3.0 mm.

The test results are shown in Table 1 where a mark x shows a rough idling state, that is, a generation of over ±30 rpm revolution fluctuation, and a mark xx shows a misfiring engine stall state due to improper insulation.

TABLE 1

| | B | | | | | | | | | | |
|---|---|---|---|---|---|---|---|---|---|---|---|
| A | 0.2 | 0.3 | 0.4 | 0.5 | 0.6 | 0.7 | 0.8 | 0.9 | 1.0 | 1.1 | 1.2 |
| 0.7 | X | ○ | ○ | ○ | ○ | XX | XX | XX | XX | XX | XX |
| 1.0 | X | ○ | ○ | ○ | ○ | ○ | ○ | ○ | XX | XX | XX |
| 1.3 | X | ○ | ○ | ○ | ○ | ○ | ○ | ○ | ○ | ○ | ○ |

Table 1 shows that the spark plug has good ignitability when the distance B is in a range of 0.3 mm≦B<A−0.1 mm.

When the distance B is less than 0.3 mm, it is contemplated that a flame core to be generated is tinny and can not be largely grown by the insulator 3 and the second ground electrode 6, 7 coming close to each other. As a result, a misfiring may tend to occur so that a stable ignitability may not be secured. On the other hand, if the distance B is more than A−0.1 mm, the spark discharge at the second discharge gap hardly take places, when carbon is deposited on the insulator 3, and the carbon causes a short circuit extending to the base portion deep into the insulator 3 so that a good ignitability may not be secured.

Further, according to another experimental test result, when the axial distance c between the leading end of the housing 2 and the front end of the insulator 3 is less than 1.0 mm, the second discharge gap can not be formed at a space sufficiently away from the housing 2, which causes a worse ignitability when fired at the second discharge gap. When the axial distance c is more than 4.0 mm, that is, when the first discharge gap is too much protruded into the combustion chamber, a heat resistance of the first ground electrode 5 gets worse and the consumption resistance of oxidization is remarkably deteriorated.

Furthermore, when the axial length H from the front end of the insulator 3 to the front end of the center electrode 4 is less than 0.5 mm, the ignitability at the first discharge gap gets worse because a flame core generated at the first discharge gap is prevented from growing by a cooling function of the surface of the insulator 3, which comes too much close to the front end of the center electrode 4.

On the other hand, the axial length H is more than 3.00 mm, a heat resistance of the center electrode 4 may be largely deteriorated as larger portions of the center electrode 4 are directly exposed to burning fuel mixture.

As a result of the above experimental test, it is concluded that, to obtain a good ignitability of the spark plug, the distance C and the distance H are 1.0 mm≦C≦4.0 mm and 0.5 ≦H≦3.0 mm, respectively.

According to further experimental tests, the ignitability of the spark at the second discharge gap is proved to be also largely influenced by a position of the front end of the second ground electrode 6, 7 axially away from the leading end of the housing 2. As mentioned before, the spark discharge at the second discharge gap occurs between the side surface or edge or the base point X of the noble metal chip 10 or the diametrically reduced electrode portion 4*b* and the front end surface or edge of the second ground electrode 6, 7.

The experimental test was conducted for detecting a revolution fluctuation rate of water cooling four cycle 1600 cc internal combustion engine with respect to the spark plug in the type as shown in FIGS. 1 to 3, after the spark plug is fouled by carbon. The test samples (900 samples) were prepared by variously changing the shortest axial length L1 from the leading end of the housing 2 to the front end of the second electrode 6, 7 in relation to the distance C. In these test samples, the distance A of the first discharge gap is 1.1 mm, the shortest distance B between the side surface of the insulator 3 and the front end of the second electrode 6, 7 is 0.8 mm, the radial thickness D of the front end of the insulator 3 is 1.0 mm, the axial length H from the front end of the insulator 3 to the front end of the diametrically reduced portion 4*b* is 1.5 mm, and the longest axial length L2 from the leading end of the housing 2 to the front end of the second electrode 6, 7 is L1+1.5 mm.

To detect the revolution fluctuation rate, an idling unstable rate on 650 rpm idling operation is used. The idling unstable rate is obtained by a formula=(standard deviation value of instantaneous revolutions/average value of instantaneous revolutions)×100%, where each of the instantaneous revolutions is detected at 0.2 second interval for 3 minutes. As the idling unstable rate is larger, which means that the revolution fluctuation is larger, the ignitability is worse.

Figure 7:
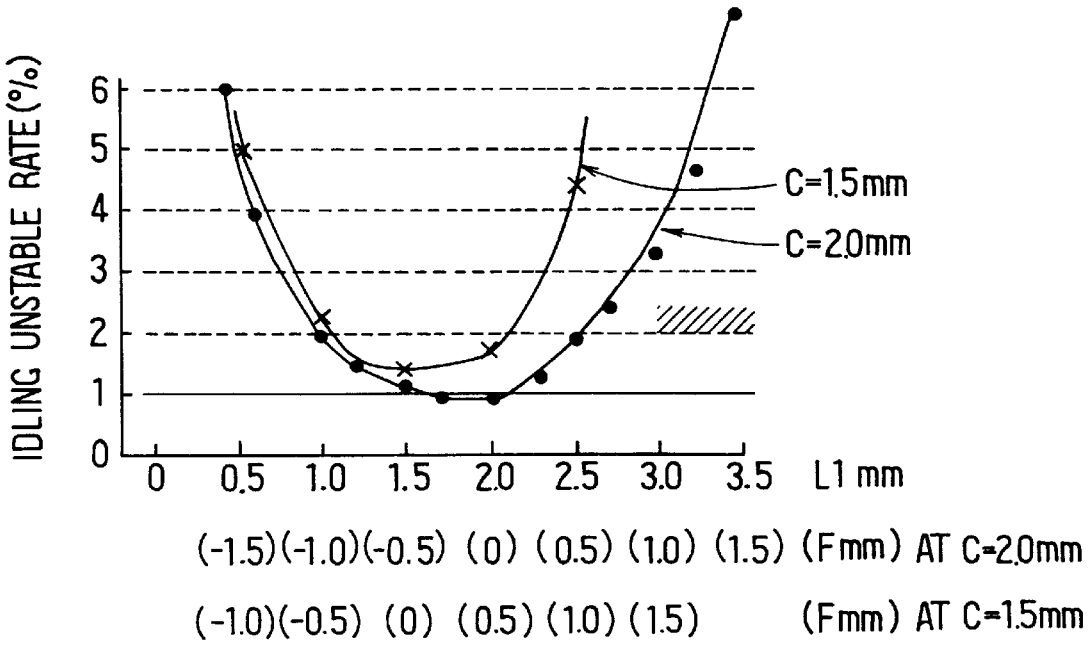
FIG. 7 is a graph showing the relationship between an idling unstable rate and a shortest axial length L1.
Figure 8:
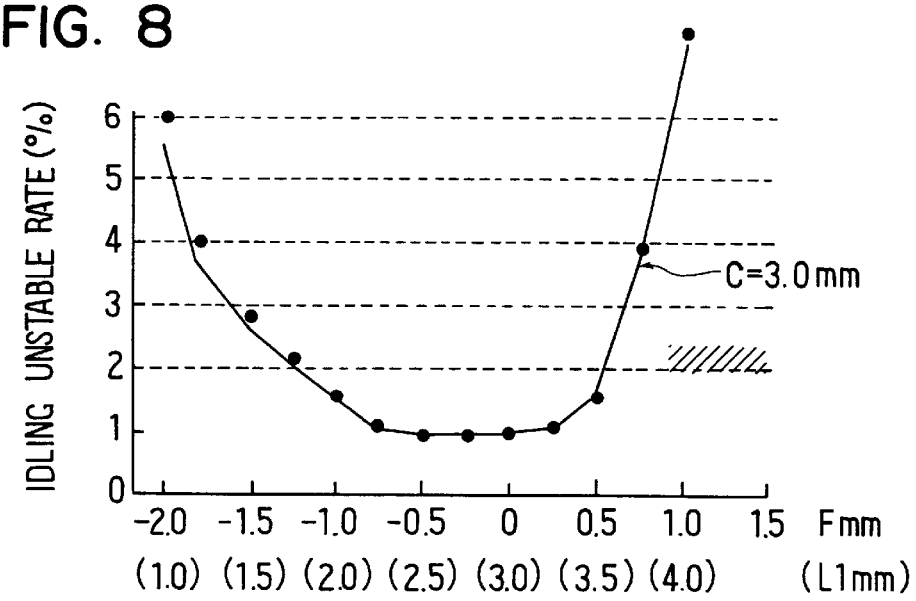
FIG. 8 is a graph showing the relationship between an idling unstable rate and an axial length F.

FIGS. 7 and 8 show the test results. FIG. 7 shows a relationship between the idling unstable rate and the shortest axial length L1 when the axial length C is 2.0 mm and 1.5 mm. respectively. On the other hand, FIG. 8 shows a relationship between the idling unstable rate and the length F when the axial length C is 3.0 mm. As the axial length F is the length from the front end of the insulator 3 to the front end edge Y of the second electrode 6, 7 on the side of the housing 2, the axial length P ig equal to the shortestE axial length L1 −the axial length C. Therefore, FIG. 7 also shows values of the axial length F corresponding to values of the shortest axial length L1 and FIG. 8 shows values of the shortest axial length L1 corresponding to values of the axial length F, respectively.

It may be concluded from the test results as shown in FIGS. 7 and 8 that, if the axial Length F is properly selected, the spark plug having a good ignitability and causing less revolution fluctuation of engines can be realized. The preferable range of the Length F is −1.0 mm≦F≦+0.5 mm.

The range of the length F as mentioned above may be supported by the following reasons. When the length F is more than +0.5 mm, that is, when the Length L1 is more than C+0.5 mm, the spark discharge flies over the front end of the insulator 3 so that carbon deposited on the front end of the insulator 3 may not be cleaned. On the other hand, When the length F is less than −1.0 mm, the spark discharge at the second discharge gap occurs on a position relatively deep into the insulator 3 and too far away from a position of the first discharge gap and, further, fuel mixture tends to be stagnant at a space between the front end of the second electrode 6, 7 and the outside surface of the insulator 3 so that ignitability may be unstable or get worse. on the other hand, when the Length L1 is less than 1.0 mm, the idling unstable rate is always high and exceeds the allowable range according to the test result shown in FIG. 7. It is contemplated, therefore, that, as the spark discharge at the second discharge gap occurs near an inner wall in the combustion chamber, the combustion is adversely affected by unstable distribution of fuel mixtures and inappropriate propagation of flame at the position near the inner wall in the combustion chamber. Therefore, it may be concluded that the preferable length L1 is in a range of 1.0 mm ≦L1≦C+0.5 mm.

Next, an appropriate length from the leading end of the insulator 3 to the base point X of the noble metal chip 10 or the diametrically reduced electrode portion 4*b* is described hereinafter.

According to the experimental test results, it is preferable that the base point X is placed inside by 0.1 to 0.8 mm from the leading end of the insulator 3. The spark discharge starting from the base point X at the second discharge gap hits at first inner surfaces of the insulator 3, then, proceeds so as to surround and creep along the leading end of the insulator 3 and, finally reaches the second ground electrode 6, 7. In this case, the spark discharge runs into carbon deposited on the leading end of the insulator 3 so that the carbon may be burned or scattered by spark energy. Thus, the carbon-fouling may be more effectively cleaned by the appropriate position of the base point X.

Figure 9:
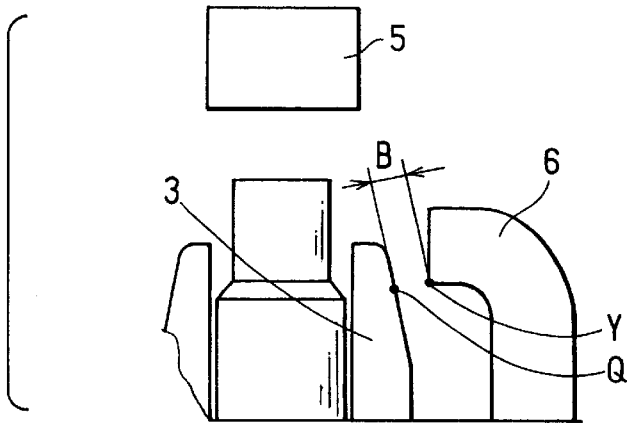
FIG. 9 is a partly enlarged view showing a portion of the spark plug for explaining an aspect of the present invention.

Further, it is preferable that the air gap spark discharge usually occurs across the first discharge gap to secure a stable good ignitability and, when the insulator 3 is fouled by carbonl, the surface creeping spark discharge occurs along the second discharge gap to burn carbons deposited on the front end of the insulator 3. For this purpose, the preferable dimensional relationship among the distance A of the first air gap, the shortest distance B between the side surface of the insulator 3 and the front end of the second electrode 6, 7, and the radial thickness D of the front end of the insulator 3 may be defined by a formula, B+D≧A. When the formula, B+D≧A, is satisfied, the spark discharge position may be effectively changed between the usual spark discharge at the first discharge gap and the carbon-fouling spark discharge at the second discharge gap. Next, when the insulator 3 has a tapered outside surface as shown in the second and third embodiments, the shortest distance B is defined by the front end edge Y of the second electrode 6, 7 and a point Q of the insulator 3 that is located on a side nearer to the housing 2 compared with the front end edge Y, as shown in FIG. 9. If the outside surface of the insulator 3 is steeply tapered, the point Q is positioned too deep into the front end of the insulator, which is not good at ignitability.

Figure 10:
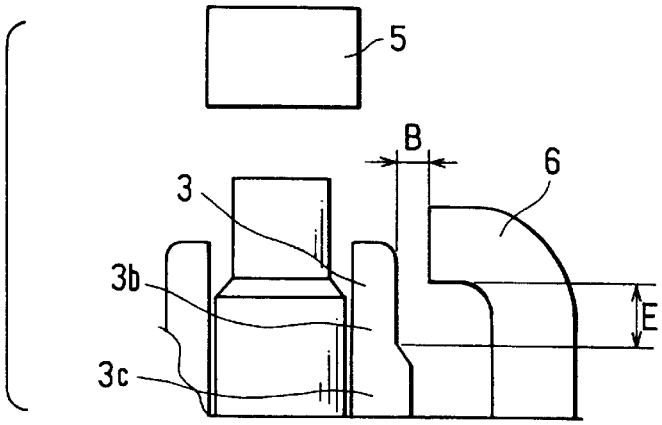
FIG. 10 is a partly enlarged view showing a portion of the spark plug for explaining another aspect of the present invention.

Therefore, preferably, the insulator 3 is provided at a vicinity of the front end thereof with a diametrically reduced insulator portion 3*c* whose diameter is nearly uniform in an axial direction and is smaller than a diameter of the base insulator portion 3*b*, as shown FIG. 10. However, it is essential that an shortest axial length E from the front end of the second ground electrode to a point where the diametrically reduced insulator portion 3*c* starts is in a range of E≧B+0.1 mm. This is for preventing the spark discharge from occurring deep into the insulator 3 so that the spark discharge may occur at the second discharge gap.

What is claimed is:

1. A spark plug comprising;

a center electrode having a front end and a front side;

an insulator having a front end, the insulator surrounding and holding the center electrode so as to expose both the front end and the front side of the center electrode out of the front end thereof;

a metal housing having a leading end, the metal housing holding the insulator so as to expose the front end of the insulator out of the leading end thereof;

a first ground electrode having a leading end and a front end, the leading end of the first ground electrode being fixed to the leading end of the metal housing so as to constitute a first discharge gap between the front end of the first ground electrode and the front end of the center electrode; and a second ground electrode having a leading end and a front end, the leading end of the second ground electrode being fixed to the leading end of the metal housing and the front end of the second ground electrode is positioned radially outside the front end of the insulator so as to constitute a second discharge gap between the front end of the second ground electrode and the front side of the center electrode, wherein dimensional relationships of the center electrode, the first and second ground electrodes, the insulator and the metal housing are respectively in ranges of;

$0.7\ \text{mm} \leqq A \leqq 1.3\ \text{mm}$, $0.3\ \text{mm} \leqq B \leqq A-0.1\ \text{mm}$ $1.0\ \text{mm} \leqq C \leqq 4.0\ \text{mm}$, $0.5\ \text{mm} \leqq H \leqq 30\ \text{mm}$, $-1.0\ \text{mm} \leqq F \leqq +0.5\ \text{mm}$, and $1.0\ \text{mm} \leqq L1 \leqq C+0.5\ \text{mm}$, where A is a distance of the first discharge gap, B is a shortest distance between the front end of the second ground electrode and the insulator, C is an axial length from the leading end of the metal housing and the front end of the insulator, H is an axial length from the front end of the insulator and the front end of the center electrode, F is an axial length from the front end of the insulator to the front end edge of the second electrode, and L1 is a shortest axial length from the leading end of the metal housing to the front end of the second ground electrode.

2. A spark plug according to claim 1, wherein the center electrode is shaped as a column having at least a first electrode portion and a second electrode portion whose diameter is smaller than that of the first electrode portion, the first and second electrode portions being integrated to constitute at a boundary thereof an edge point located inside by 0.1 to 0.8 mm from the front end of the insulator.

3. A spark plug according to claim 1, wherein the distance A is in a range of a formula, $B+D \geqq A$, where D is a radial length of the front end of the insulator.

4. A spark plug according to claim 1, wherein the insulator is provided at a vicinity of the front end thereof with a base insulator portion and a diametrically reduced insulator portion whose diameter is nearly uniform in an axial direction and is smaller than a diameter of the base insulator portion, a shortest axial length E from the front end of the second ground electrode to a point where the diametrically reduced insulator portion starts being in a range of $E \geqq B+0.1$ mm.

5. A spark plug according to claim 1, wherein at least one of the first ground electrode and the center electrode is provided with a noble metal chip at a portion where the first spark gap is constituted.

6. A spark plug according to claim 5, wherein the center electrode is shaped as a column having abase electrode portion, a first diametrically reduced electrode portion whose diameter is smaller than that of the base electrode portion, and a second diametrically reduced electrode portion whose diameter is smaller than that of the first diametrically reduced portion, the second diametrically reduced portion being formed by the noble metal chip.

7. A spark plug according to claim 5, wherein the noble metal chip is made of any one material of pure Pt, pure Ir, Pt alloy and Ir alloy.

* * * * *